US005201816A

United States Patent [19]

Schivley, Jr.

[11] Patent Number: 5,201,816

[45] Date of Patent: Apr. 13, 1993

[54] SIDE ANGLE DRILLING APPARATUS

[75] Inventor: George P. Schivley, Jr., Richardson, Tex.

[73] Assignee: Ingersoll-Rand Company, Woodcliff Lake, N.J.

[21] Appl. No.: 962,155

[22] Filed: Oct. 15, 1992

Related U.S. Application Data

[63] Continuation of Ser. No. 779,551, Oct. 18, 1991, abandoned.

[51] Int. Cl.[5] ..... F21C 11/02

[52] U.S. Cl. ..... 173/184; 173/28; 173/193

[58] Field of Search ..... 173/184, 185, 28, 42, 173/190, 193, 194

[56] References Cited

U.S. PATENT DOCUMENTS

| | | | |
|---|---|---|---|
| 3,245,180 | 4/1966 | Bules et al. . | |
| 3,256,943 | 6/1966 | Lindgren | 173/43 |
| 3,302,731 | 2/1967 | Perry | 173/43 |
| 3,447,613 | 6/1969 | Lisenby | 173/28 |
| 3,576,218 | 4/1971 | Lisenby | 173/28 |
| 3,605,912 | 9/1971 | Fisher | 173/43 |
| 3,919,816 | 11/1975 | Ranft | 173/43 |
| 3,992,831 | 11/1976 | Bukovitz et al. . | |
| 4,347,692 | 9/1982 | Culver . | |
| 4,465,144 | 8/1984 | Gugger et al. . | |
| 4,915,180 | 4/1990 | Schisler | 173/43 |

FOREIGN PATENT DOCUMENTS

| | | |
|---|---|---|
| 17922/70 | 7/1970 | Australia . |
| 1395766 | 5/1972 | United Kingdom . |

*Primary Examiner*—Douglas D. Watts
*Assistant Examiner*—Scott A. Smith
*Attorney, Agent, or Firm*—John J. Selko

[57] ABSTRACT

An apparatus includes a vehicular mainframe having a vehicular longitudinal axis and a substructure mounted on the mainframe. The substructure has a substructure longitudinal axis and is tiltable relative to the vehicular mainframe about the substructure longitudinal axis. The apparatus includes a tower and a tower support rigidly secured to the substructure. The substructure longitudinal axis is approximately the same vertical height as an upper surface of the vehicular mainframe.

5 Claims, 3 Drawing Sheets

SIDE ANGLE DRILLING APPARATUS

This application is a continuation of application Ser. No. 07/779,551, filed Oct. 18, 1991, now abandoned.

BACKGROUND OF THE INVENTION

This invention relates generally to vehicular drilling towers and supports and more particularly to a device which permits relative lateral tilting of the tower relative to a vehicle.

Previous drilling tower support vehicles pivoted the tower only about the vehicle lateral axis. For this reason, any drilling performed at an angle relative to a high wall or drop off embankment requires that the vehicular longitudinal axis be perpendicular to the high wall. When more holes are being drilled, the vehicle must be backed away from the high wall, turned and then driven parallel to the high wall and then turned towards the high wall, and finally moved to the position of the next hole to be drilled.

Some vehicular drill assemblies incorporate pivoting tower structures to accommodate tilting of the tower laterally relative to the vehicle. The pivoting portion used in these types of pivoting tower structures is inherently weak and inapplicable to vehicular towers which are relatively tall or heavy. Since surface mining towers are usually quite tall, a different type of pivoting structure is required.

Vehicular drill assemblies with pivoted towers also result in the path of the rotating tower conflicting with any other member located on the mainframe. For example, the drill string of the tower may contact the operator's cab which is mounted to the mainframe.

The foregoing illustrates limitations known to exist in present vehicular tower supports. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus including a vehicular mainframe having a vehicular longitudinal axis and a substructure mounted on the mainframe. The substructure has a substructure longitudinal axis and is tiltable relative to the vehicular mainframe about the substructure longitudinal axis. The apparatus includes a tower and means rigidly secured to the substructure for supporting the tower.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
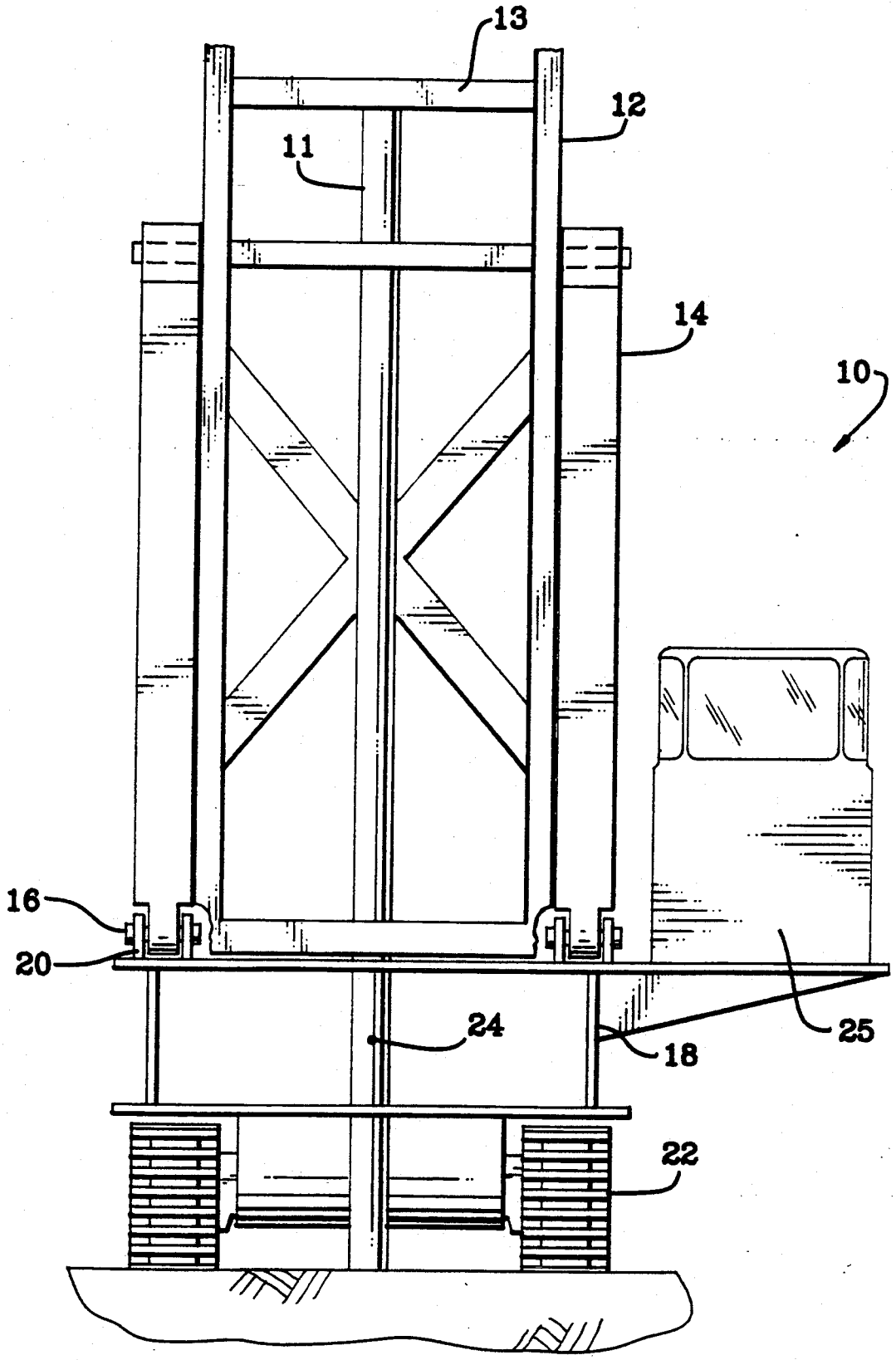
FIG. 1 (PRIOR ART)
FIG. 1 is a front, partially cross sectional view illustrating an embodiment of tower support of the prior art.

FIG. 1 illustrates a prior art vehicular tower structure illustrated generally as 10. A tower 12 is pivotally supported by a tower support 14. Also, the tower support 14 pivots about pivot 16 by any device well known in the art. Towers of this type are typically used in blast hole drilling applications, and as such support a drill string 11 and a rotary head 13 as are well known in the art.

The tower support 14 is secured to a vehicular mainframe 18 by a plurality of clevises 20. The vehicular mainframe 18 is supported by vehicular wheels or treads 22 in such a manner that the vehicular mainframe 18 may travel along a vehicular longitudinal axis 24. A cab 25 is mounted to the vehicular mainframe 18 in close proximity to the tower 12.

Figure 2:
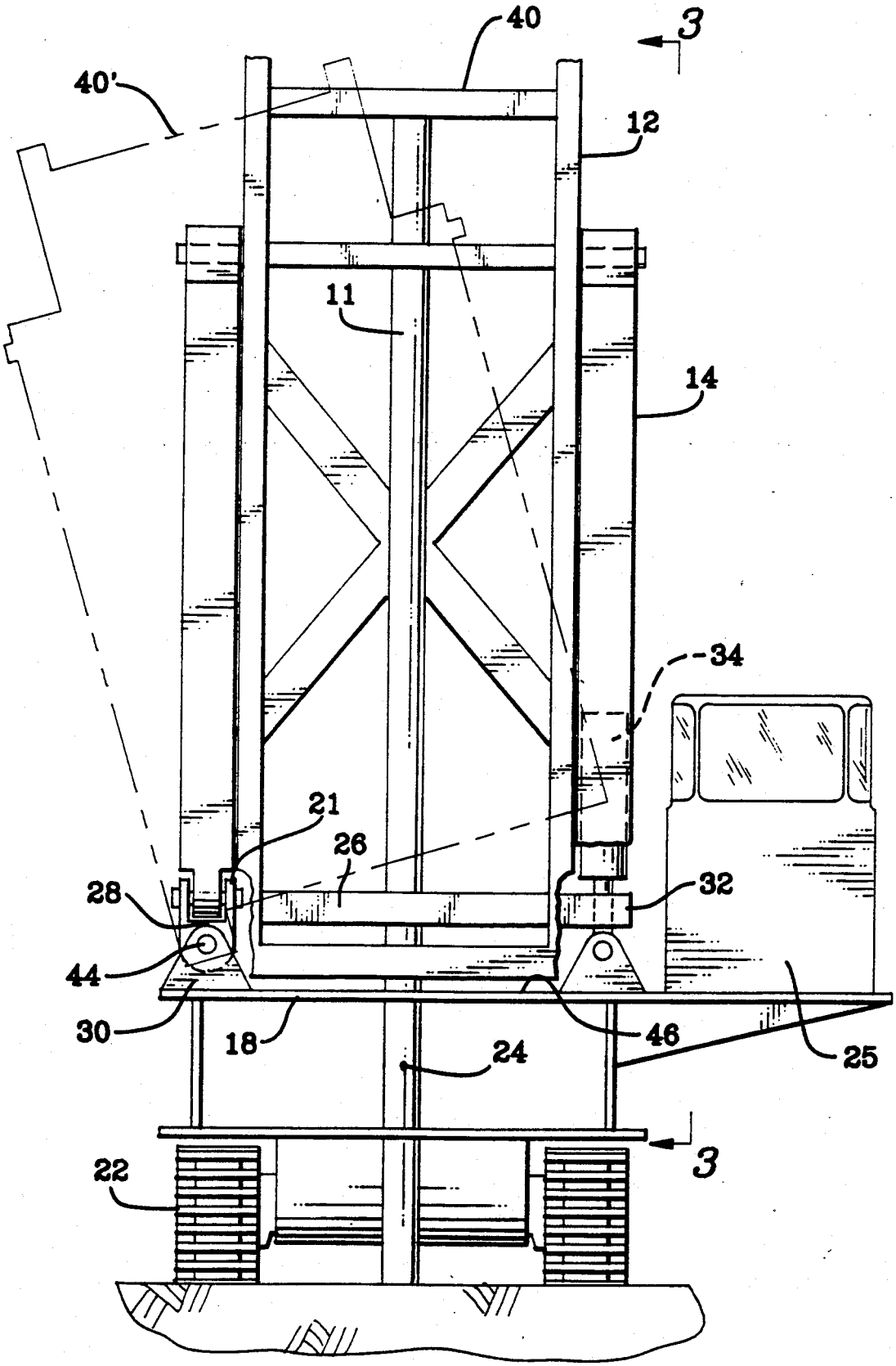
FIG. 2 is a front, partially cross sectional view illustrating an embodiment of tower support of the present invention.
Figure 3:
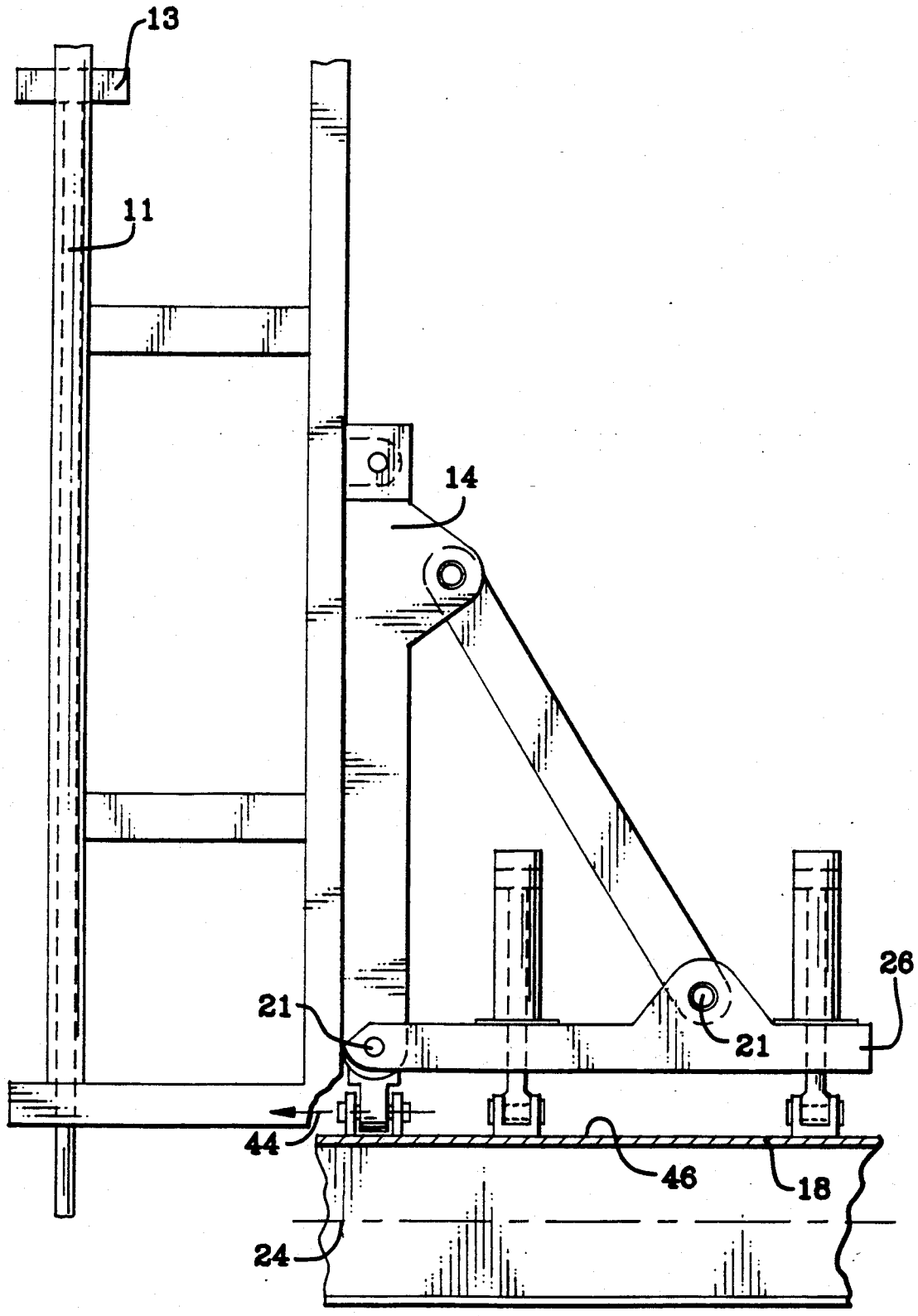
FIG. 3 is a view as taken along sectional lines 3—3 of FIG. 2.

The present invention, as illustrated in FIGS. 2 and 3, involves the addition of a tiltable substructure 26. The clevises 21 attach the tower support 14 to the tiltable substructure 26 in this embodiment, in place of the vehicular mainframe 18 as illustrated in FIG. 1.

End 28 of the tiltable substructure 26 is affixed to the vehicular mainframe 18 by at least one clevis 30. End 32 of the tiltable substructure 26 is attached to the vehicular mainframe by an at least one extension member 34. End 32 is opposed to end 28. The extension member 34 may be a fluid actuated piston, a screw member or any other displacement producing mechanism well known in the art and applicable to the present invention.

Any actuation of the extension member 34 displaces the tower 12, the tower support 14 and the tiltable substructure 26 between the positions shown as 40 and 40'. This displacement, since the pivoting occurs at clevis 30 which is approximately the same vertical height as the vehicular mainframe 18, does not cause excess lateral motion of the tower 12, the tower support 14 or the tiltable substructure 26 towards the cab 25 or any other member mounted to the vehicular mainframe 18, to the right of extension member 34 as illustrated in FIG. 2.

A substructure longitudinal axis 44 is typically laterally displaced from, and parallel to, the vehicular longitudinal axis 24. Any rotation of the tiltable substructure occurs about the substructure longitudinal axis 44, which is coincident with the clevis 30 pivot point. This rotation results in displacement of the tower 12, the tiltable substructure 26 and the tower support between positions 40 and 40' as illustrated in FIG. 2.

The substructure longitudinal axis 44 is in close proximity to an upper surface 46 of the vehicular mainframe 18. Due to this configuration, the drill string, at the level of the mainframe, will not undergo an excessive lateral displacement as the tower support is pivoted between positions 40 and 40'.

While this invention has been illustrated and described in accordance with a preferred embodiment, it is recognized that other variations and changes may be made therein without departing from the invention as set forth in the claims.

Having described the invention, what is claimed is:

1. A tiltable drilling apparatus comprising:

a. a vehicular main frame having a first and second side edge;

b. a tiltable substructure mounted transversely across said mainframe, said substructure including:

(i) first and second oppositely spaced ends;

(ii) said first end pivotally attached to said main frame adjacent a first side edge of said mainframe, for pivoting about a first pivot axis;

(iii) said second end attached to said main frame adjacent a second side edge of said mainframe by an extension member, whereby actuation of said extension member pivots said substructure about said first pivot axis;

c. a tower support pivotally attached to said substructure for pivoting about a second pivot axis, said second pivot axis being adjacent to said first side edge of said main frame and transverse to said first pivot axis; and d. a tower mounted on said tower support.

2. The drilling apparatus of claim 1 wherein said tower is spaced above said main frame, between said first and second sides thereof.

3. The drilling apparatus of claim 2 further including a cabin mounted on said main frame adjacent said second end of said substructure.

4. The drilling apparatus of claim 3 wherein said first pivot axis is in close proximity to an upper surface of said mainframe, whereby a drill string on said tower will not undergo excessive lateral displacement, as said tower is pivoted.

5. A tiltable drilling apparatus comprising:

a. a vehicular main frame;

b. a tiltable substructure mounted transversely across said main frame, said substructure pivotable about a first pivot axis adjacent a first side edge of said mainframe;

c. a tower support connected to said substructure, said tower support extending substantially across said main frame, said tower support pivotable about a second pivot axis, said second pivot axis adjacent to said first side edge of said main frame and transverse to said first pivot axis;

d. a tower connected to said tower support, said tower tiltable above said mainframe; and e. means for pivotally tilting said substructure about said first pivot axis, whereby said tower remains above said mainframe.

* * * * *